US007565704B2

(12) United States Patent
Wu

(10) Patent No.: US 7,565,704 B2
(45) Date of Patent: Jul. 28, 2009

(54) SPORTS HELMET

(76) Inventor: Happy Wu, 6F, No. 43, Lane 325, Juang Jihng Rd., Taipei (TW)

( * ) Notice: Subject to any disclaimer, the term of this patent is extended or adjusted under 35 U.S.C. 154(b) by 565 days.

(21) Appl. No.: 11/344,121

(22) Filed: Feb. 1, 2006

(65) Prior Publication Data

US 2006/0225187 A1 Oct. 12, 2006

(30) Foreign Application Priority Data

Apr. 8, 2005 (TW) ..... 94205491 U

(51) Int. Cl.
*A42B 1/22* (2006.01)

(52) U.S. Cl. ..... 2/418; 2/410; 2/411; 2/417; 2/421; 2/425; 24/68 R; 24/68 B

(58) Field of Classification Search ..... 2/411, 2/421, 425, 410, 195.1, 418, 417; 24/68 B, 24/68 R, 68 SK
See application file for complete search history.

(56) References Cited

U.S. PATENT DOCUMENTS 2,205,742 A * 6/1940 Bowers ..... 2/418
2,739,310 A * 3/1956 Frieder et al. ..... 2/418
3,041,622 A * 7/1962 Gurtowski ..... 2/8.1
3,047,876 A * 8/1962 Malcom, Jr. ..... 2/9
4,888,831 A * 12/1989 Oleson ..... 2/420
4,942,628 A * 7/1990 Freund ..... 2/418
5,331,687 A * 7/1994 Kronenberger ..... 2/195.2
5,357,654 A * 10/1994 Hsing-Chi ..... 2/418
5,950,245 A * 9/1999 Binduga ..... 2/417
6,154,889 A * 12/2000 Moore et al. ..... 2/418
6,256,798 B1 * 7/2001 Egolf et al. ..... 2/421
6,314,588 B1 * 11/2001 Fang ..... 2/418
6,708,376 B1 * 3/2004 Landry ..... 2/418
6,865,752 B2 * 3/2005 Udelhofen et al. ..... 2/425
D508,659 S * 8/2005 Fang ..... D11/200
7,000,262 B2 * 2/2006 Bielefeld ..... 2/418
7,043,772 B2 * 5/2006 Bielefeld et al. ..... 2/418
7,114,197 B2 * 10/2006 Garneau et al. ..... 2/421
7,174,575 B1 * 2/2007 Scherer ..... 2/418
7,222,374 B2 * 5/2007 Musal et al. ..... 2/421

* cited by examiner

*Primary Examiner*—Gary L Welch
*Assistant Examiner*—Nathan E Durham
(74) *Attorney, Agent, or Firm*—Lowe Hauptmen Ham & Berner, LLP

(57) ABSTRACT

A safe protective sports helmet is provided which includes a hat body, the hat body is provided therein with a circle of a head encircling element, and is provided rotatably thereon with a rotatable adjusting button. The head encircling elements and the rotatable adjusting button are movably connected with each other. By rotating the rotatable adjusting button, the head encircling elements can be adjusted to fit the head size of a user.

2 Claims, 9 Drawing Sheets

SPORTS HELMET

BACKGROUND OF THE INVENTION

1. Field of the Invention

The present invention relates to a safe protective sports helmet, and more particularly to a safe protective sports helmet which is structurally simple and convenient for adjusting, by rotating an adjusting button, a head size adjusting means can be adjusted to a size fitting a head size of a user easily; the sports helmet is applicable to ball games, car competitions and other sports in need of protecting the safety of the head of a user.

2. Description of the Prior Art

In sports having vigorous actions or limb contacts such as skating, skating with in-line skates, bicycle riding or playing a baseball game or a hockey ball game etc., once there is impact, such sports are subjected to inducing body injures, and among them head injures are most serious.

Thereby, in sports having vigorous actions or limb contacts, in order to avoid head injures, generally people put on safe protective sports helmets to diminish collision force during impacts. And designing of a safe protective sports helmet concentrates to light weight, vibration resisting and vibration absorbing, in order that a user can have convenience in use and for motion, still the head of the user can be appropriately protected.

Safe protective sports helmets now available in the market have fixed sizes and with tying belts to achieve the adjustment purpose. Thereby the user must choose and buy a safe protective sports helmet with a fixed size, and after adjusting the tying belt, he can wear the helmet firm. However, because of the tight tying belt, the user will feel discomfort when he wears the helmet for a long time and the tying belt renders the user look bad.

In view of the above defect of the conventional structure, the inventor of the present invention provides improvement after nonstop studying and developing.

SUMMARY OF THE INVENTION

The primary objective of the present invention is to provide a safe protective sports helmet that is structurally simple and convenient for adjusting.

In order to achieve the above stated objective, a safe protective sports helmet provided by the present invention includes a hat body which is provided therein with a circle of head encircling means, and is provided thereon with a rotatable adjusting button fixed on the hat body, the head encircling means and the rotatable adjusting button are movably connected. By rotating the rotatable adjusting button, the head encircling means can be adjusted to fit the head size of a user.

The present invention will be apparent after reading the detailed description of the preferred embodiment thereof in reference to the accompanying drawings.

DETAILED DESCRIPTION OF THE PREFERRED EMBODIMENT

Figure 1:
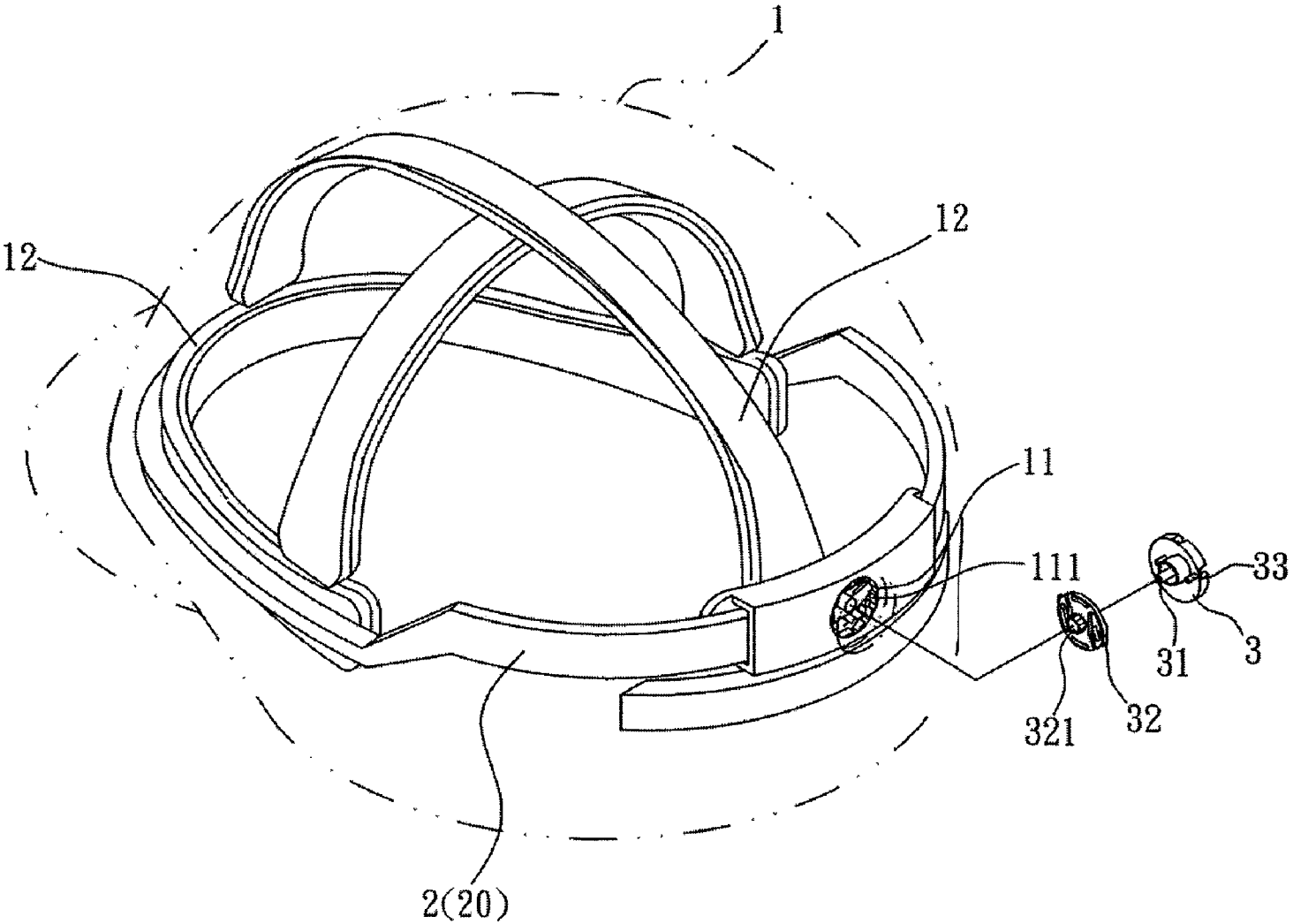
FIG. 1 is a perspective schematic view showing an exploded appearance of a safe protective sports helmet of the present invention.
Figure 1A:
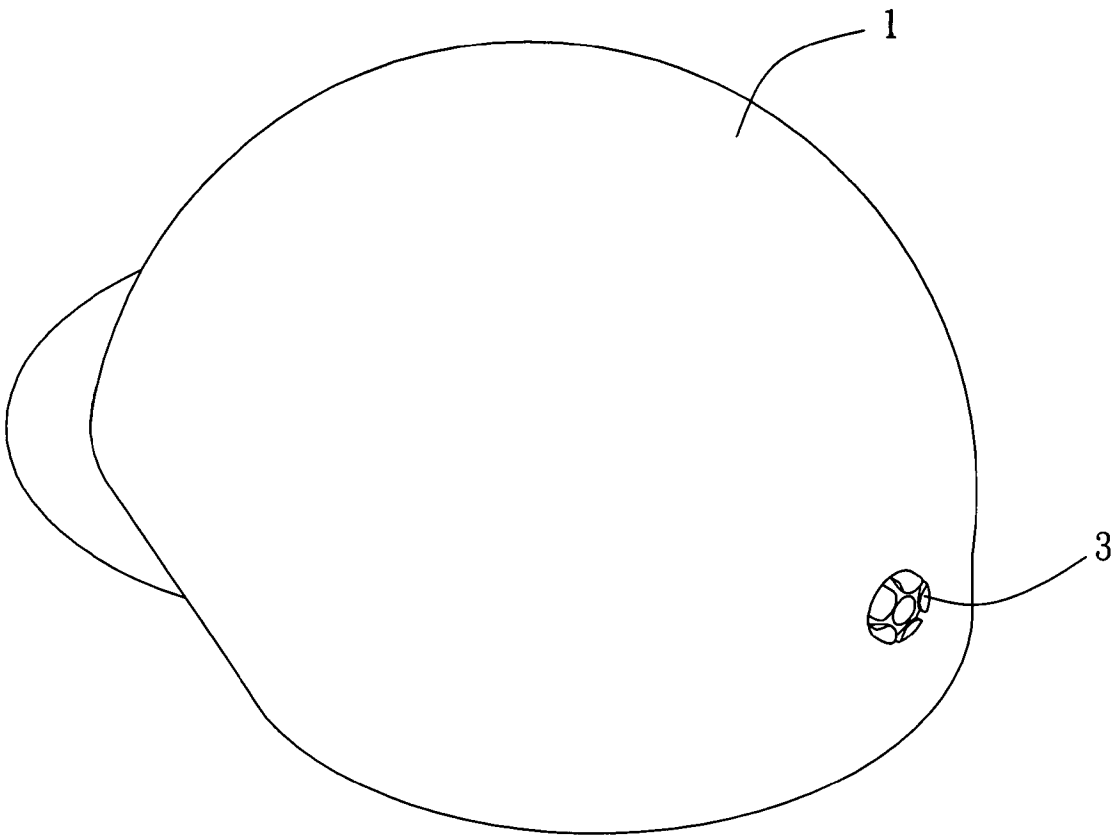
FIG. 1A is a perspective view showing the appearance of the safe protective sports helmet of the present invention.
Figure 2:
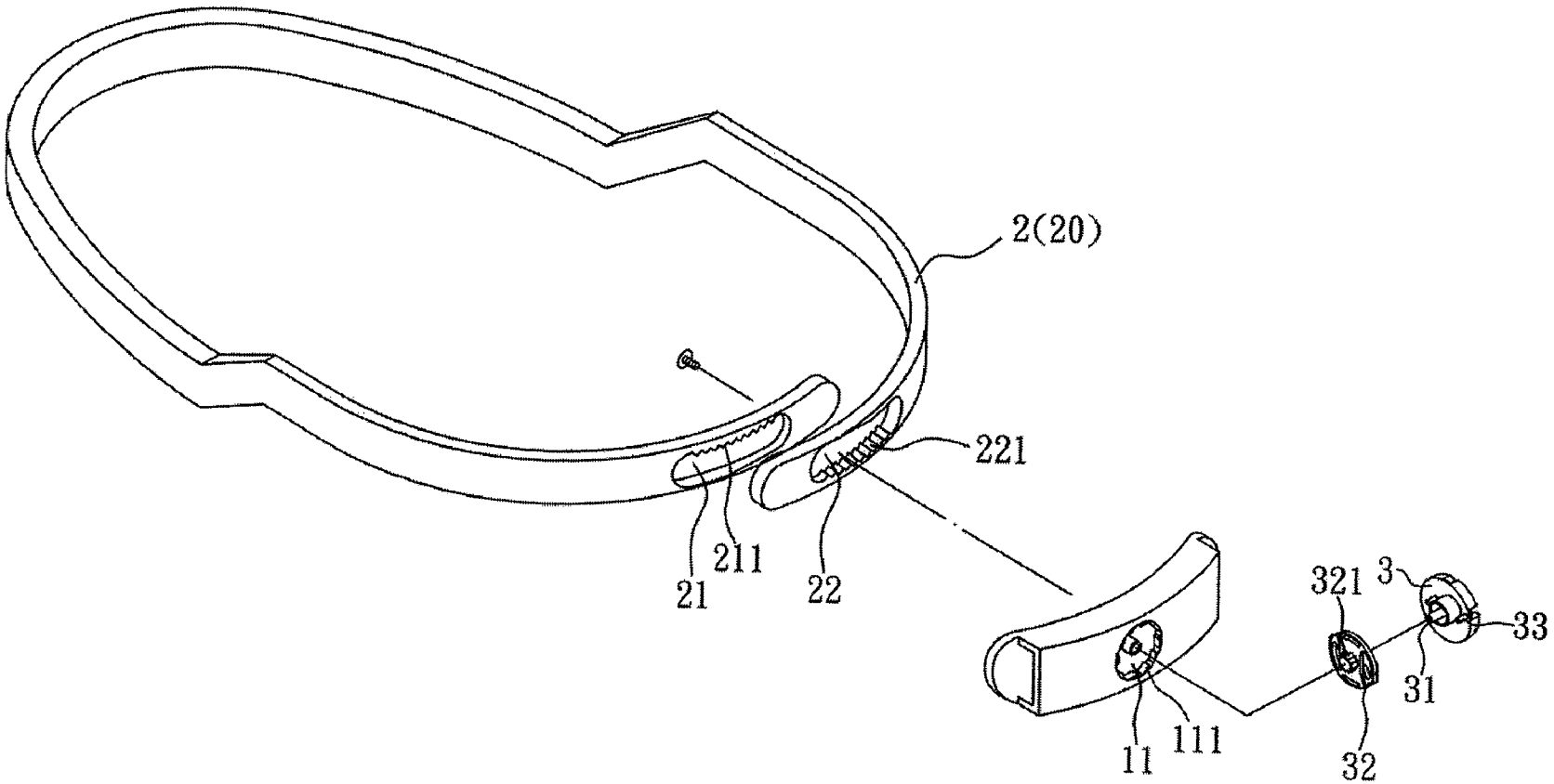
FIG. 2 is an anatomic perspective view showing the appearance of a part of the safe protective sports helmet of the present invention.
Figure 3:
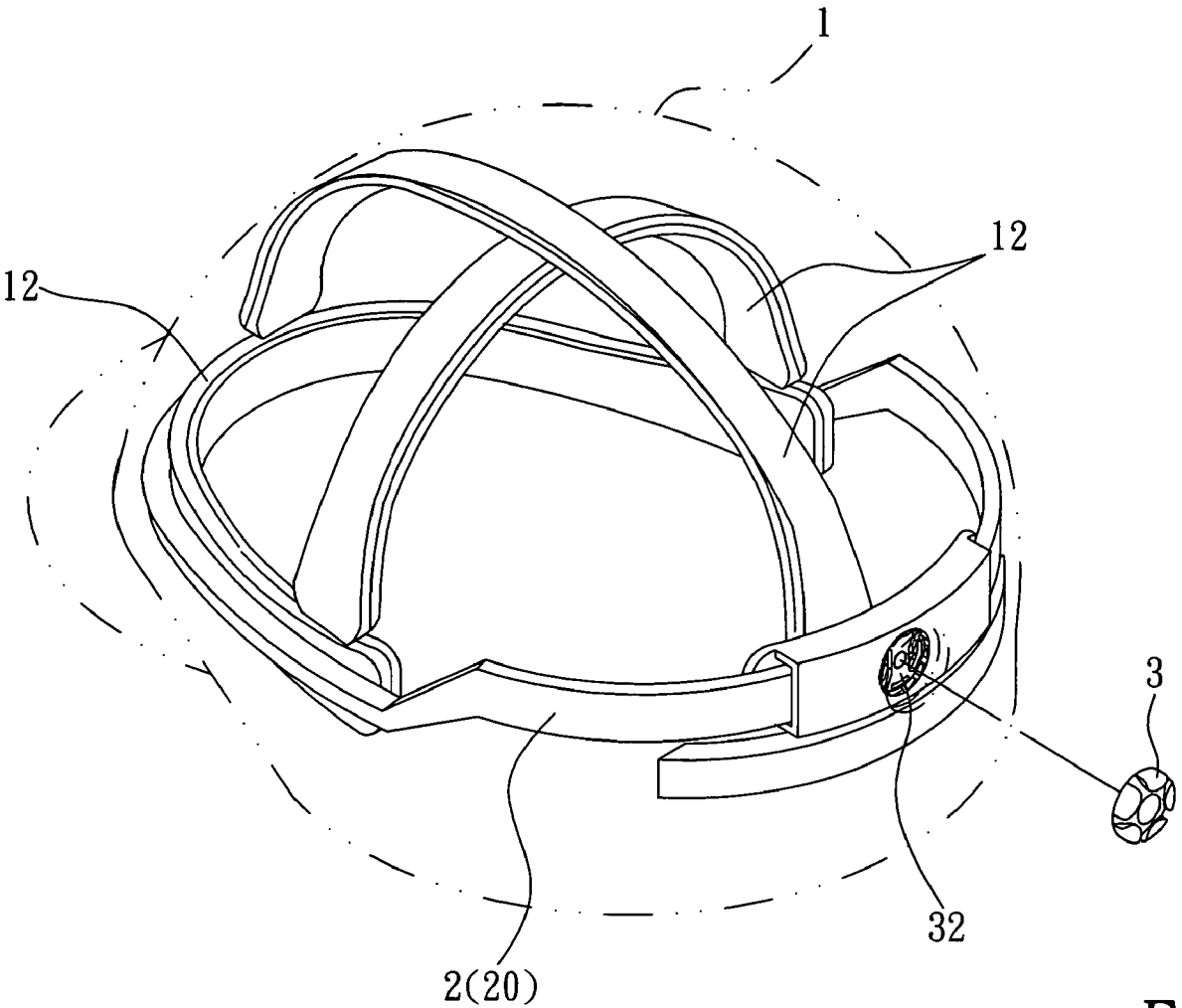
FIG. 3 is a perspective schematic view showing an exploded appearance of the safe protective sports helmet of the present invention after assembling.
Figure 4:
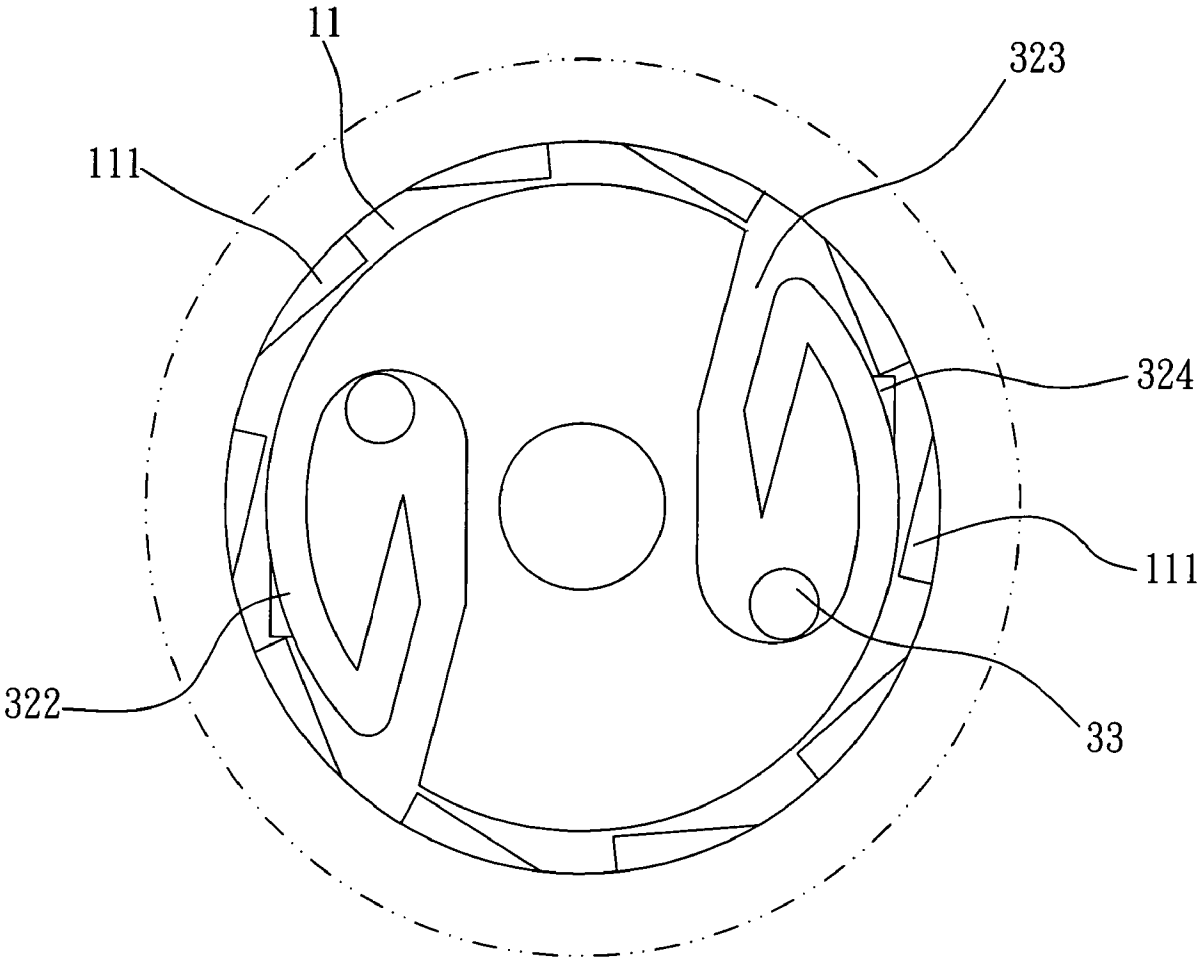
FIG. 4 is a schematic view showing the actions between a disk and a plurality of clockwise or counterclockwise spines when a rotatable adjusting button rotates to a direction of the present invention.

Referring to FIGS. 1-4 showing an embodiment of a safe protective sports helmet of the present invention, the sports helmet includes a hat body 1 which is provided therein with a circle of head encircling means 2 and is provided thereon rotatably with a rotatable adjusting button 3; the hat body 1 and the head encircling means 2 are movably connected by means of the rotatable adjusting button 3.

The hat body 1 has a hole 11. The head encircling means 2 is a belt member 20 having respectively on its two ends two openings 21, 22, and the two openings 21, 22 have on one side of each a line of engaging teeth 211 and 221 respectively. The rotatable adjusting button 3 has a central axle 31 for extending into a disk 32, the disk 32 has a gear 321 protruding centrally out of it; when in assembling, the gear 321 can exactly engage with the engaging teeth 211 and engaging teeth 221 of the two openings 21, 22 mutually aligned for connecting the two ends of the belt member 20. The central axle 31 of the rotatable adjusting button 3 then is extended through the two openings 21, 22 to make movable connection of the rotatable adjusting button 3 with the belt member 20. Hence when the rotatable adjusting button 3 is rotated left or right, the gear 321 of the disk 32 makes contracting and releasing of the belt member 20 and the two openings 21, 22 on the two ends of the belt member 20 are not separated for being restrained by the central axle 31.

The disk 32 is provided at the two sides of the gear 321 each with a hook 322; the root ends of the hooks 322 are connected with the disk 32, while the front ends of them each form with the disk 32 a gap 323. The hooks 322 each has a protrusion 324 on its outer side; the rotatable adjusting button 3 is provided inside thereof with protruding posts 33 for engaging the hooks 322 of the disk 32, Thus, when the rotatable adjusting button 3 is rotated, the disk 32 can be rotated by virtue that the hooks 322 are moved by the protruding posts 33. The hole 11 of the hat body 1 is provided therein with a plurality of clockwise or counterclockwise spines 111. Thereby, when the rotatable adjusting button 3 is not rotated, the protrusions 324 of the hooks 322 can exactly abut against the spines 111, hence the belt member 20 is maintained in a fixed state; when the rotatable adjusting button 3 is rotated clockwise or counterclockwise, the root ends of the hooks 322 in connecting with the disk 32 make the gaps 323 reduced by moving of the protruding posts 33, and make the protrusions 324 of the hooks 322 forced to snap forwards, thus the disk 32 is rotated;

when the rotatable adjusting button 3 is rotated to the opposite direction (one of the clockwise and the counterclockwise directions), the front ends of the hooks 322 are moved by the protruding posts 33 to reduce the gaps 323, thus the protrusions 324 of the hooks 322 are released from the restraining of the clockwise or counterclockwise spines 111 to allow the disk 32 to rotate.

And the hat body 1 is provided therein with a plurality of protective cushions 12, the head encircling means 2 is provided between the hat body 1 and the protective cushions 12. Parts of the protective cushions 12 are fixed in the hat body 1, and other parts of the protective cushions 12 are connected with the head encircling means 2. Thereby when the rotatable adjusting button 3 is rotated left or right, the gear 321 makes contracting and releasing of the belt member 20, the head encircling means 2 can link up with the protective cushions 12 connected with it in order to adjust the head encircling means 2 to get a size fitting a head size of a user.

Figure 5:
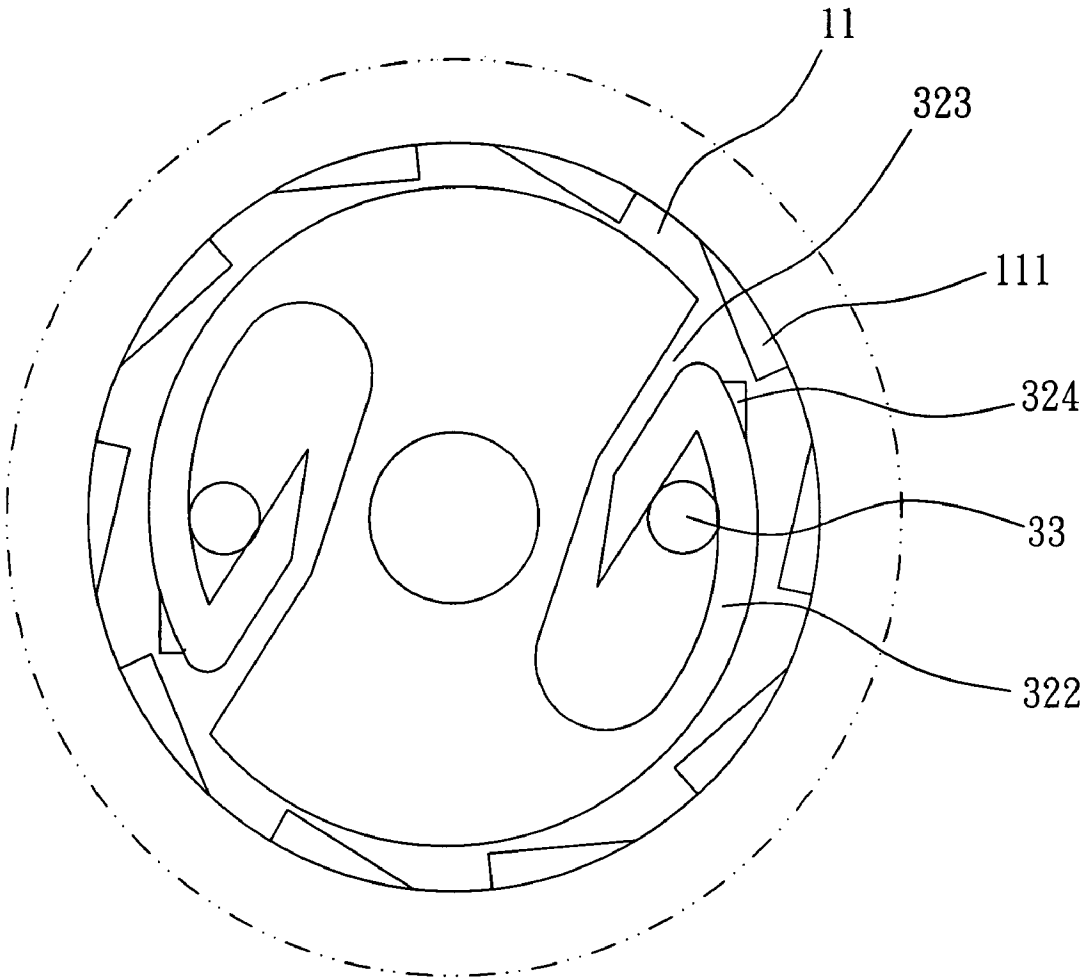
FIG. 5 is a schematic view showing the actions between the disk and the clockwise or counterclockwise spines when the rotatable adjusting button rotates to the other direction of the present invention.
Figure 6:
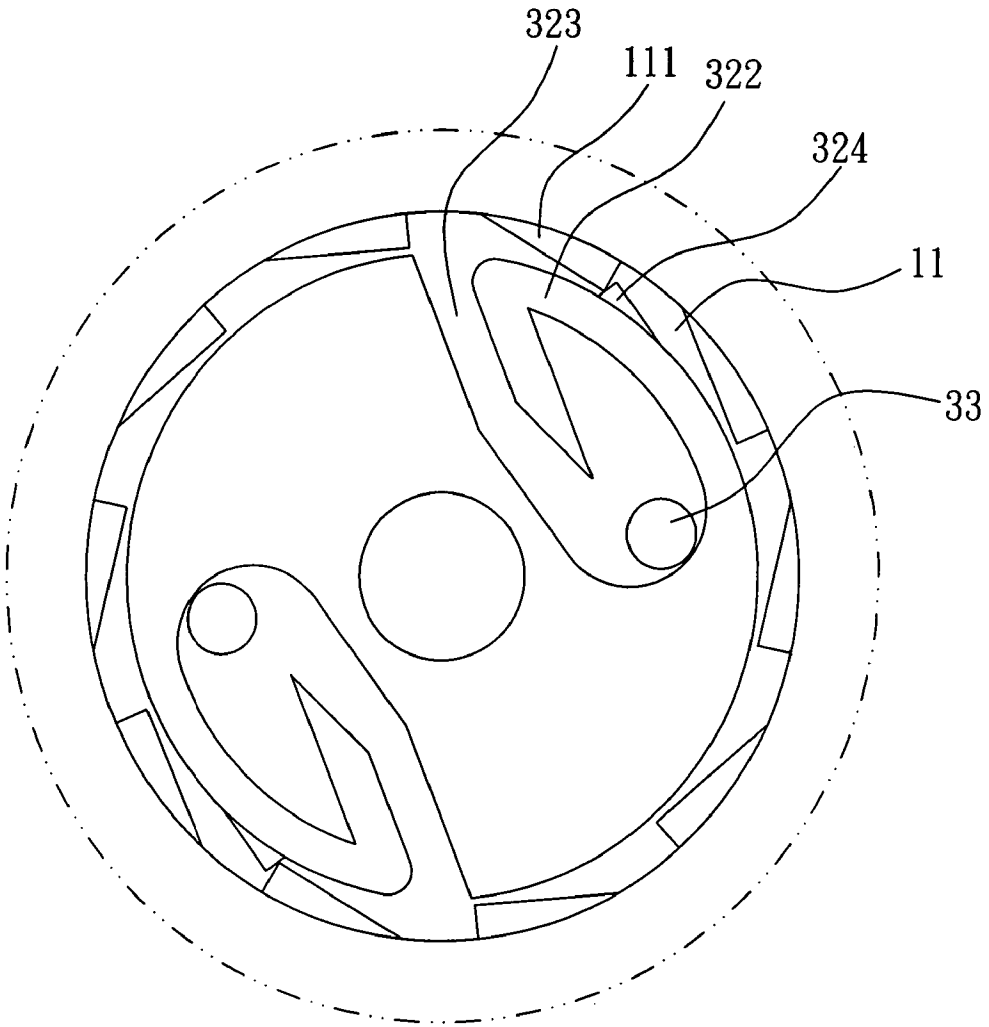
FIG. 6 is a schematic view showing the state of the disk after rotating of FIG. 5.
Figure 7:
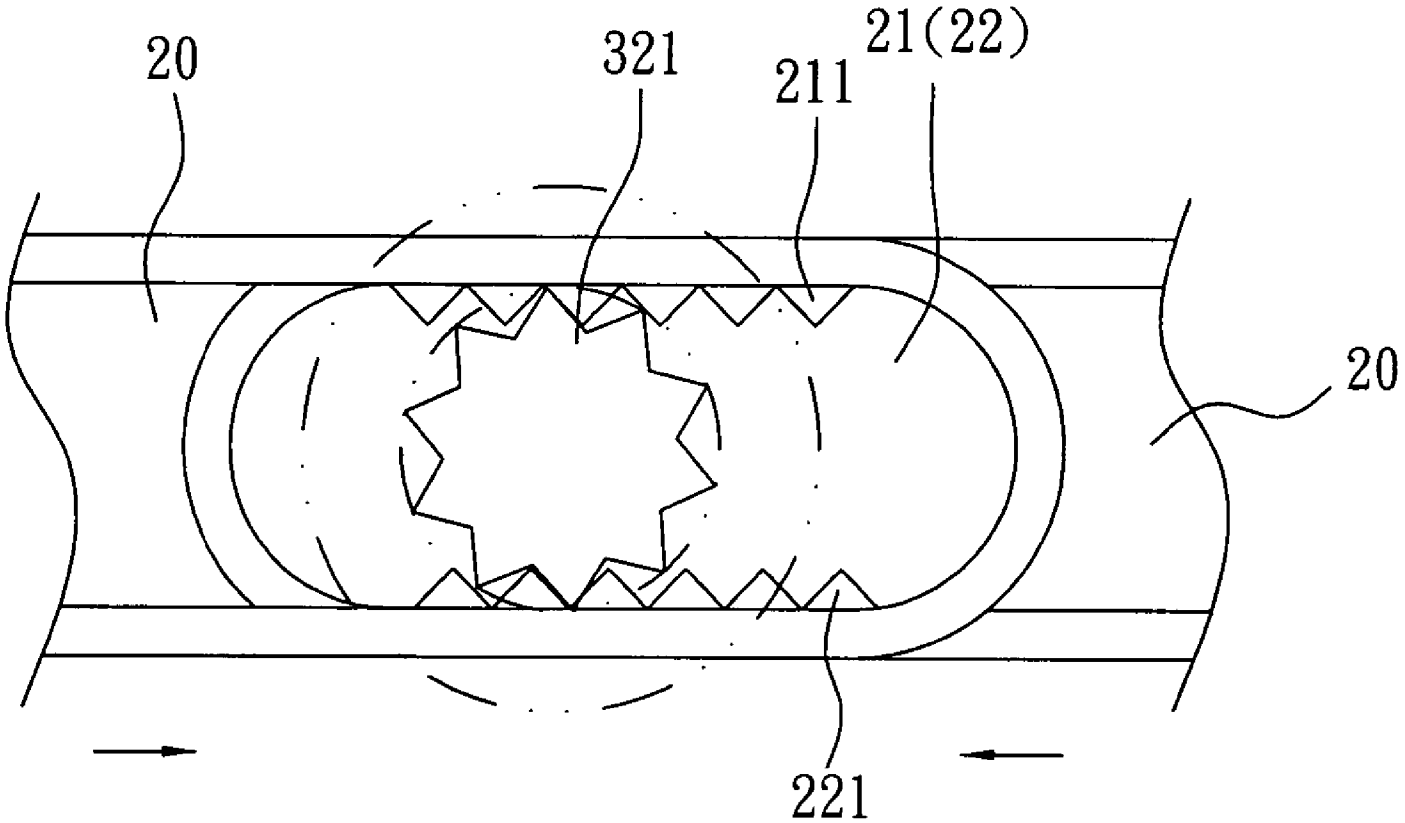
FIG. 7 is a schematic view showing the state of the disk when a belt of the embodiment of the present invention is contracted.
Figure 8:
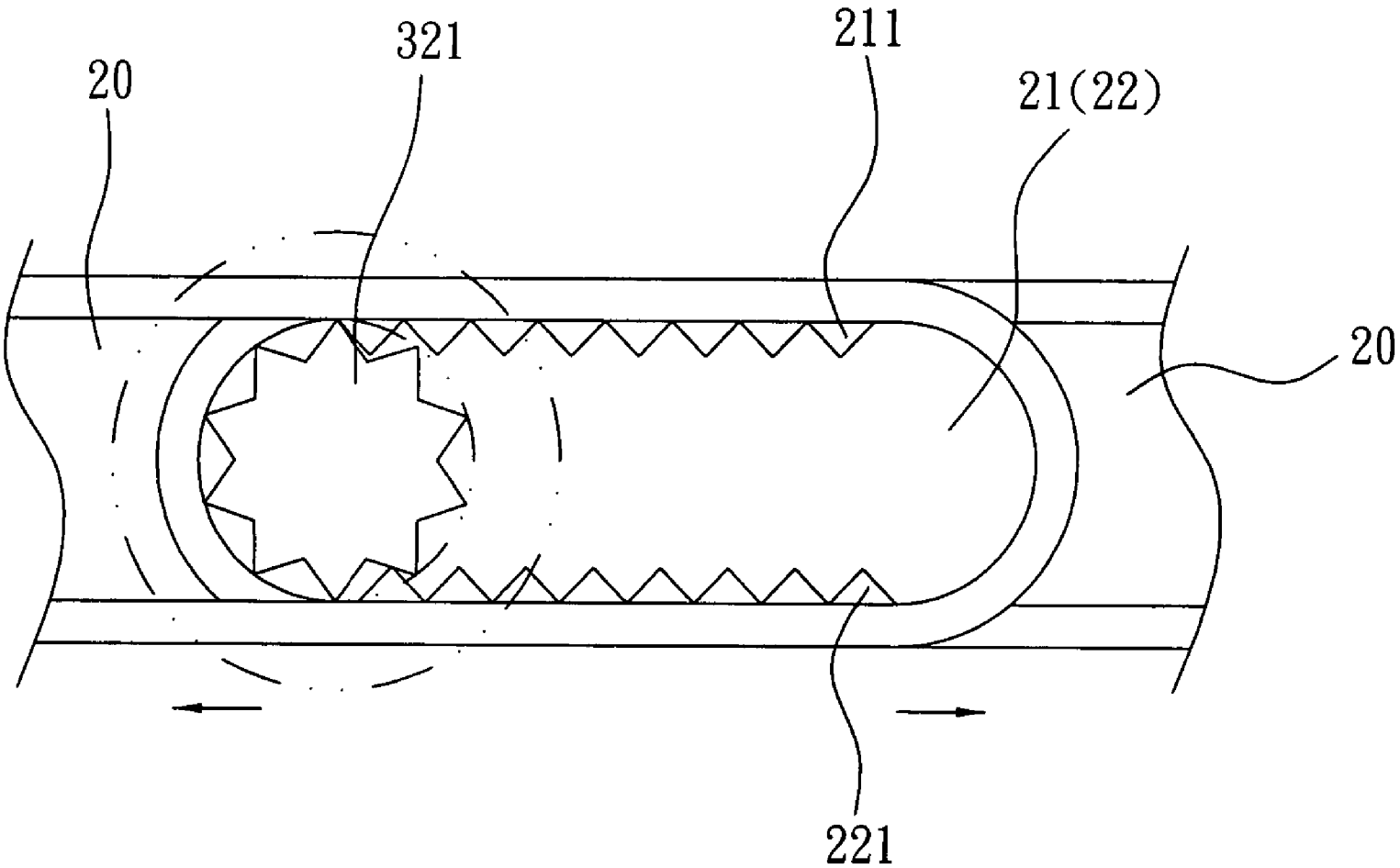
FIG. 8 is a schematic view showing the state of the disk when the belt of the embodiment of the present invention is released.

When in use, as shown in FIGS. 5-8, after the user wears the safe protective sports helmet of the present invention, he can make adjustment by rotating the rotatable adjusting button 3. When the rotatable adjusting button 3 is rotated to a direction, the gear 321 engaging with the engaging teeth 211 and 221 respectively of the two openings 21, 22 on the two ends of the belt member 20 is moved by the protruding posts 33 of the rotatable adjusting button 3 to link up with the two ends of the belt member 20 to form a contracting or releasing state. For example, when the rotatable adjusting button 3 is rotated clockwise, the engaging teeth 211 and 221 of the two openings 21, 22 respectively on the two ends of the belt member 20 are linked up to render the two ends of the belt member 20 to move in mutually opposite directions to get a contracting state; on the contrary, when the rotatable adjusting button 3 is rotated counterclockwise, the engaging teeth 211 and 221 of the two openings 21, 22 respectively on the two ends of the belt member 20 are linked up to render the two ends of the belt member 20 to move in mutually opposite directions to get a releasing state.

Thereby, the safe protective sports helmet of the present invention has a design in combination of the rotatable adjusting button 3 and the belt member 20 which makes the belt member 20 contract or release when the rotatable adjusting button 3 is rotated. The design is simple, costs low and yet is convenient for a user. No matter what head size is, the hat body 1 can be tightly and firmly fitting the user, thus the safety purpose can be also achieved.

The above stated is only for illustrating the present invention, and not for giving any limitation to the scope of the present invention. It will be apparent to those skilled in this art that various equivalent modifications or changes according to the idea of and without departing from the spirit of this invention shall also fall within the scope of the appended claims.

In conclusion, according to the description disclosed above, the present invention surely can get the expected object thereof to provide a safe protective sports helmet. Having thus described the technical process of my invention having high practical value, what

I claim as new and desire to be secured by Letters Patent of the United States is:

1. A safe protective sports helmet comprising a hat body which is provided with therein a circle of head encircling means, and is provided thereon with a rotatable adjusting button fixed on said hat body, said head encircling means and said rotatable adjusting button are movably connected; by rotating said rotatable adjusting button, said head encircling means is adjusted to fit head size of a user;

wherein said hat body has a hole; said head encircling means is a belt member having respectively on its two ends two openings, said two openings have on one side of each a line of engaging teeth; said rotatable adjusting button has a central axle for extending into a disk, said disk has a gear protruding centrally out of it; when in assembling, said gear exactly engages with said engaging teeth of said two openings mutually aligned for connecting said two ends of said belt member; said central axle of said rotatable adjusting button then is extended through said two openings to make movable connection of said rotatable adjusting button with said belt member, hence when said rotatable adjusting button is rotated left or right, said gear of disk makes contracting and releasing of said belt member, said two openings on said two ends of said belt member are not separated for being restrained said central axle; and wherein said disk is provided at two sides of said gear each with a hook; root ends of said hooks are connected with said disk, while front ends of said hooks each form with said disk a gap; said hooks each has a protrusion on its outer side; said rotatable adjusting button is provided inside thereof with protruding posts for engaging said hooks of said disk, so that when said rotatable adjusting button is rotated, said disk is rotated by virtue that said hooks are moved by said protruding posts, said hole of said hat body is provided therein with a plurality of clockwise or counterclockwise spines; thereby, when said rotatable adjusting button is not rotated, said protrusions of said hooks exactly abut against said spines, hence said belt member is maintained in a fixed state; when said rotatable adjusting button is rotated clockwise or counterclockwise, said root ends of said hooks in connecting with said disk make said gaps reduced by moving of said protruding posts, and make said protrusions of said hooks forced to snap forwards, thus said disk is rotated; when said rotatable adjusting button is rotated to an opposite one to said direction (one of said directions being rotated clockwise and counterclockwise), said front ends of said hooks are moved by said protruding posts to reduce said gaps, thus said protrusions of said hooks are released from restraining of said clockwise or counterclockwise spines to allow said disk to rotate.

2. The safe protective sports helmet as in claim 1, wherein said hat body is provided therein with a plurality of protective cushions, said head encircling means is provided between said hat body and said protective cushions, parts of said protective cushions are fixed in said hat body, and other parts of said protective cushions are connected with said head encircling means; thereby when said rotatable adjusting button is rotated, said head encircling means links up with said protective cushions connected with it.

* * * * *